US010137348B2

(12) United States Patent
Molinari et al.

(10) Patent No.: US 10,137,348 B2
(45) Date of Patent: Nov. 27, 2018

(54) METHOD AND APPARATUS FOR LOW RESOLUTION GOLF SWING IMAGE CAPTURE ANALYSIS

(71) Applicant: NIKE, Inc., Beaverton, OR (US)

(72) Inventors: Arthur Molinari, Portland, OR (US); Nicholas A. Leech, Beaverton, OR (US); Nicholas Yontz, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/691,258

(22) Filed: Aug. 30, 2017

(65) Prior Publication Data

US 2017/0361193 A1 Dec. 21, 2017

Related U.S. Application Data

(63) Continuation of application No. 13/664,622, filed on Oct. 31, 2012, now Pat. No. 9,782,654.

(60) Provisional application No. 61/555,968, filed on Nov. 4, 2011.

(51) Int. Cl.

| | |
|---|---|
| ***A63F 13/00*** | (2014.01) |
| ***A63B 69/36*** | (2006.01) |
| ***A63B 24/00*** | (2006.01) |

(52) U.S. Cl.

CPC ..... *A63B 69/36* (2013.01); *A63B 24/0003* (2013.01); *A63B 69/3623* (2013.01); *A63B 2024/0028* (2013.01); *A63B 2220/12* (2013.01); *A63B 2220/13* (2013.01); *A63B 2220/16* (2013.01); *A63B 2220/56* (2013.01); *A63B 2220/805* (2013.01); *A63B 2220/806* (2013.01)

(58) Field of Classification Search

CPC ..... A63B 59/0074; A63B 24/0003; A63B 69/3667

See application file for complete search history.

(56) References Cited

U.S. PATENT DOCUMENTS

2004/0172213 A1* 9/2004 Kainulainen ..... A63B 69/3608 702/141
2004/0219964 A1* 11/2004 Bleckley ..... A63B 24/0003 463/13
2007/0270214 A1* 11/2007 Bentley ..... A61B 5/1122 463/30

(Continued)

*Primary Examiner* — Reginald Renwick
(74) *Attorney, Agent, or Firm* — Quinn IP Law

(57) ABSTRACT

A method and system for using a low resolution image of a golfer's swing for analysis is disclosed. Cameras obtain images of various portions of a golfer's swing. A computer calculates parameters associated with a golfer and a golf club from the images. Parameters include body angles, head position, shoulder positions, arm positions, hand positions, leg positions, foot positions, club shaft angles, and club head position. Different portions of the swing are captured using the cameras, including a static initial address, a backswing, a downswing, a forward swing, and a follow-through. A computer uses measured parameters from two or more portions of the swing to determine comparative parameters during different portions of the swing. The computer uses the parameters to generate swing analysis outputs, including swing characteristic information and/or swing profile information. A correlation table relates identified swing analysis outputs to recommendations to the golfer to improve the swing.

13 Claims, 13 Drawing Sheets

(56) References Cited

U.S. PATENT DOCUMENTS

| | | | | |
|---|---|---|---|---|
| 2009/0017930 | A1* | 1/2009 | Burnett | A63B 24/0003 473/227 |
| 2011/0086720 | A1* | 4/2011 | Jaekel | A63B 24/0003 473/223 |

* cited by examiner

1102

1100

ADDRESS

BACK SWING

TRANSITION TO DOWN SWING

| 1104 SWING ANALYSIS OUTPUT | 1106 INPUT SOURCE | 1108 EFFECT ON BALL | 1110 RECOMMENDATION |
|---|---|---|---|
| COCK WRISTS AT TAKE AWAY | FRONT | MORE SPIN/SLICE | LOWER SPIN BALL/PRACTICE |
| INSIDE/OUTSIDE TAKE AWAY | REAR | HOOK/ SLICE | LOWER SPIN BALL/PRACTICE |
| BACKSWING TOO LONG | FRONT | | PRACTICE |
| HEEL LIFT DURING BACKSWING | FRONT/ REAR | LOSS OF DISTANCE | DISTANCE BALL/ INCREASE FELXIBILITY |
| HEAD/BODY SWAY DURING BACKSWING | FRONT | | PRACTICE |
| CASTING AT TOP OF BACKSWING | FRONT | LOSS OF DISTANCE | DISTANCE BALL/PRACTICE |
| X-FACTOR ANGLE | FRONT | SMALLER ANGLE = LESS POWER/ SPIN | DISTANCE BALL/ INCREASE FELXIBILITY |
| OVER THE TOP ON TRANSITION TO DOWNSWING | REAR | MORE SIDESPIN/ BACKSPIN | LOWER SPIN BALL/PRACTICE |

FIG. 11A

1100

1102

1104 1106 1108 1110

| | SWING ANALYSIS OUTPUT | INPUT SOURCE | EFFECT ON BALL | RECOMMENDATION |
|---|---|---|---|---|
| TRANSITION TO DOWN SWING | REVERSE PIVOT | FRONT/ FOOT SENSORS | INCON-SISTENT CONTACT/ LOSS OF DISTANCE | GAME IMPROVEMENT BALL/PRACTICE |
| | RATIO OF BACKSWING TIME TO DOWNSWING TIME | FRONT | | PRACTICE |
| FORWARD SWING | ANGLE OF CLUB ATTACK | FRONT | STEEP = HIGH SPIN SHALLOW = LOW SPIN | HIGHER/LOWER SPIN BALL |
| | HIGH ANGULAR SPEED TRANSFER FROM FOREARMS TO CLUB | FRONT | MORE SPIN | LOWER SPIN BALL |
| | HEAD POSITION DROPPING FROM INITIAL SET UP | FRONT | LESS SPIN/ HIGHER LAUNCH | LOWER TRAJECTORY, HIGHER SPIN BALL/ PRACTICE |
| | HEAD POSITION RISING FROM INITIAL SET UP | FRONT | MORE SPIN/ LOWER LAUNCH | HIGHER TRAJECTORY, HIGHER SPIN BALL/ PRACTICE |
| IMPACT | LAUNCH ANGLE OF BALL | FRONT | | VARY DIMPLE PATTERN/BALL COMPRESSION |
| FOLLOW-THROUGH | VISUALLY, SHOT IMMEDIATELY LEFT/RIGHT | REAR | PATH OF BALL LEFT/RIGHT | VARY BALL BASED ON CONTACT TIME |

FIG. 11B

METHOD AND APPARATUS FOR LOW RESOLUTION GOLF SWING IMAGE CAPTURE ANALYSIS

CROSS-REFERENCE TO RELATED APPLICATIONS

This application is a continuation of U.S. patent application Ser. No. 13/664,622, filed on 31 Oct. 2012, published as US 2013/0116808, which claims the benefit of priority from U.S. Provisional Patent No. 61/555,968, filed 4 Nov. 2011, both of which are incorporated herein by reference in their entirety for all purposes.

BACKGROUND

The present invention relates to a system and method of analyzing a golfer's swing, and in particular to a system and method of using a low resolution image capture of a golfer's swing for analysis.

The game of golf requires that the golfer exhibit fine control over the mechanics of his or her swing. Small differences in a golfer's swing can dramatically affect how the golf ball is hit and subsequently plays. Both amateur and professional golfers spend sizeable amounts of time developing the muscle memory and fine motor skills necessary to improve their game.

A variety of devices are known in the art that can measure parameters associated with a golf swing. Such devices can enable a golfer to measure various aspects of his or her swing, so that the golfer may critique and improve these aspects. These devices generally require that a golfer take swings at a ball while being monitored by launch monitors, video devices and other measuring devices. The measurements generally taken include the club head speed, ball speed, launch angle, attack angle, backspin, sidespin and total distance, among others.

However, such devices suffer from several deficiencies. Foremost among these is cost. Some types of launch monitors generally use radar technology in conjunction with the Doppler effect to measure the speed and position of the golf club and ball. These launch monitors must be capable of emitting the precise type of radar necessary, as well as analyzing the shift in frequency due to the Doppler effect, in order to provide useful information to the golfer. The launch monitors therefore tend to be expensive, and can be especially cost prohibitive for amateur golfers. In addition, launch monitors can require professional calibration and set up to be able to obtain accurate information.

A golfer seeking feedback about his or her swing characteristics may also employ a golf professional to watch the golfer's swing and provide feedback about various positions of the golfer's body before, during, and after hitting the ball. Obtaining this type of feedback, however, can be expensive. In addition, a golfer may not have any recorded information available to him or her from this type of feedback.

Accordingly, there is a need in the art for a system and method that would allow amateur and professional golfers alike to be able to capture and analyze various aspects of their swings in an accurate and cost effective manner.

SUMMARY

A method and system for using a low resolution image capture of a golfer's swing for analysis is disclosed. In one aspect, the invention provides a method for generating a golf swing analysis output of a golfer's swing, comprising: obtaining a plurality of images from at least one camera; calculating at least one parameter associated with one or more of a golfer and a golf club based on the obtained images using a computer; and generating a swing analysis output from the computer identifying at least one swing characteristic information and/or swing profile information associated with the golfer's swing.

In another aspect, the invention provides a system for generating a golf swing analysis output of a golfer's swing, the system comprising: at least one camera for obtaining a plurality of images associated with one or more portions of the golfer's swing; a computer in communication with the at least one camera, the computer being configured to calculate at least one parameter associated with one or more of a golfer and a golf club based on the obtained images; and at least one swing analysis output generated by the computer, the swing analysis output identifying at least one swing characteristic information and/or swing profile information associated with the golfer's swing.

In another aspect, the invention provides a method for generating a golf swing analysis output of a golfer's swing, comprising: obtaining a plurality of images associated with two or more portions of the golfer's swing from at least one camera; calculating a first parameter associated with one or more of a golfer and a golf club based on the obtained images from a first portion of the golfer's swing using a computer; calculating a second parameter associated with one or more of the golfer and the golf club based on the obtained images from a second portion of the golfer's swing using the computer; and comparing the first parameter and the second parameter to generate a swing analysis output from the computer identifying at least one swing characteristic information and/or swing profile information associated with the golfer's swing.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention may be better understood with reference to the following drawings and description. The components in the figures are not necessarily to scale, emphasis instead being placed upon illustrating the principles of the invention. Moreover, in the figures, like reference numerals designate corresponding parts throughout the different views.

FIG. 11A is a representational view of an exemplary embodiment of a table correlating analysis outputs associated with a golfer's swing to recommendations;

FIG. 11B is a representational view of an exemplary embodiment of a table correlating analysis outputs associated with a golfer's swing to recommendations.

DETAILED DESCRIPTION

Conventional launch monitors, video devices and other measuring devices typically used to record characteristics associated with a golfer's swing focus on obtaining measurements associated with the movement and parameters of the golf ball as it is being hit, the initial launch, and during flight. Accordingly, conventional launch monitors and video devices for recording a golfer's swing require high resolution images of the golf ball taken at various times during a golfer's swing, including during impact of the club head and golf ball and during launch of the golf ball on an initial flight path, to accurately measure the parameters associated with the golf ball and, therefore, the golfer's swing.

An exemplary embodiment of a process for capturing information associated with a golfer's swing for analysis is described herein. In some embodiments, the process includes obtaining low resolution images of the golfer's swing from one or more image capture devices, including a high-speed camera. High-speed cameras capable of taking video and/or still images at a rapid rate, including at a rate from 200 frames per second to up to 2000 frames per second. However, images acquired at such a rapid rate may be generally of a lower resolution than may be obtained using the type of conventional launch monitors and video devices typically used to record characteristics associated with a golfer's swing. As a result, an accurate measurement of the various parameters associated with the movement of the golf ball during and after the golfer's swing, is not possible within the resolution limits of the high-speed camera images. Accordingly, the exemplary embodiment of the process for using a low resolution image capture of a golfer's swing for analysis described herein instead focuses on measuring one or more parameters associated with a golfer's body and/or golf club position during the swing.

Figure 1:
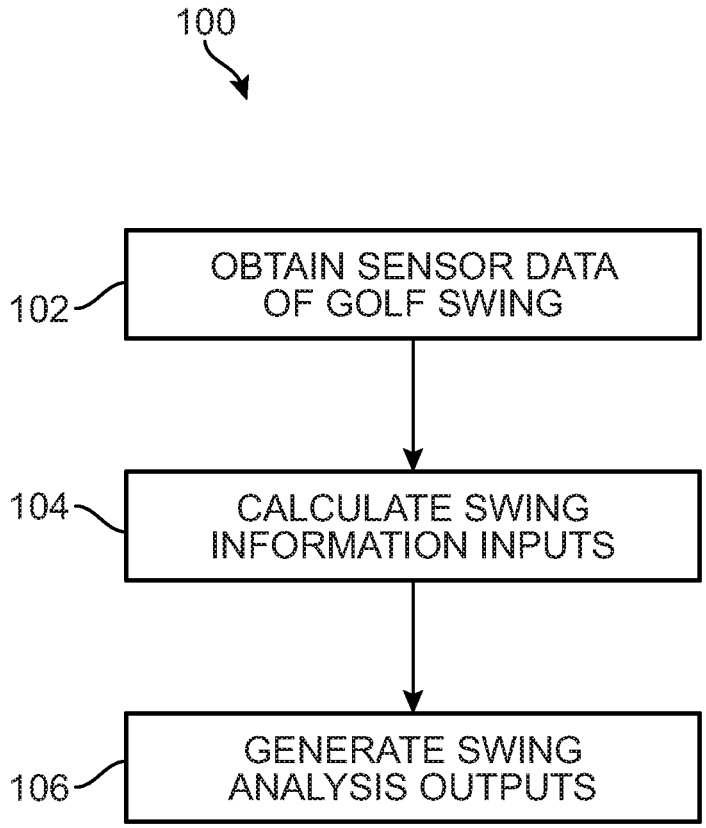
FIG. 1 is a representational view of an exemplary embodiment of a process for using a low resolution image capture of a golfer's swing for analysis.

FIG. 1 is a representational view of an exemplary embodiment of a process 100 for using a low resolution image capture of a golfer's swing for analysis. In some embodiments, sensor data associated with a golf swing of a golfer may be obtained from one or more sources at step 102. In an exemplary embodiment, the sensor data obtained at step 102 may be obtained from one or more cameras, including high-speed cameras, as further described below. Next, process 100 may include a step 104 of calculating swing information using the sensor data obtained from step 102. In an exemplary embodiment, step 104 may include calculating one or more parameters associated with positions of a golfer's body and/or golf club position during the swing.

In some embodiments, process 100 may further include using the calculated swing information from step 104 as inputs to generate swing analysis outputs at step 106. In an exemplary embodiment, calculated swing information may be used to analyze the swing of a golfer and make recommendations regarding training, ball selection, club selection including putter matching, as well as other changes to improve the golfer's swing. In addition, in some embodiments, the generated swing analysis outputs may be used as part of additional golf-related processes or systems, as further described below, including, but not limited to: ball fitting systems, club fitting systems, golfer profile information, training and/or practice regimens, as well as general feedback to the golfer.

Figure 2:
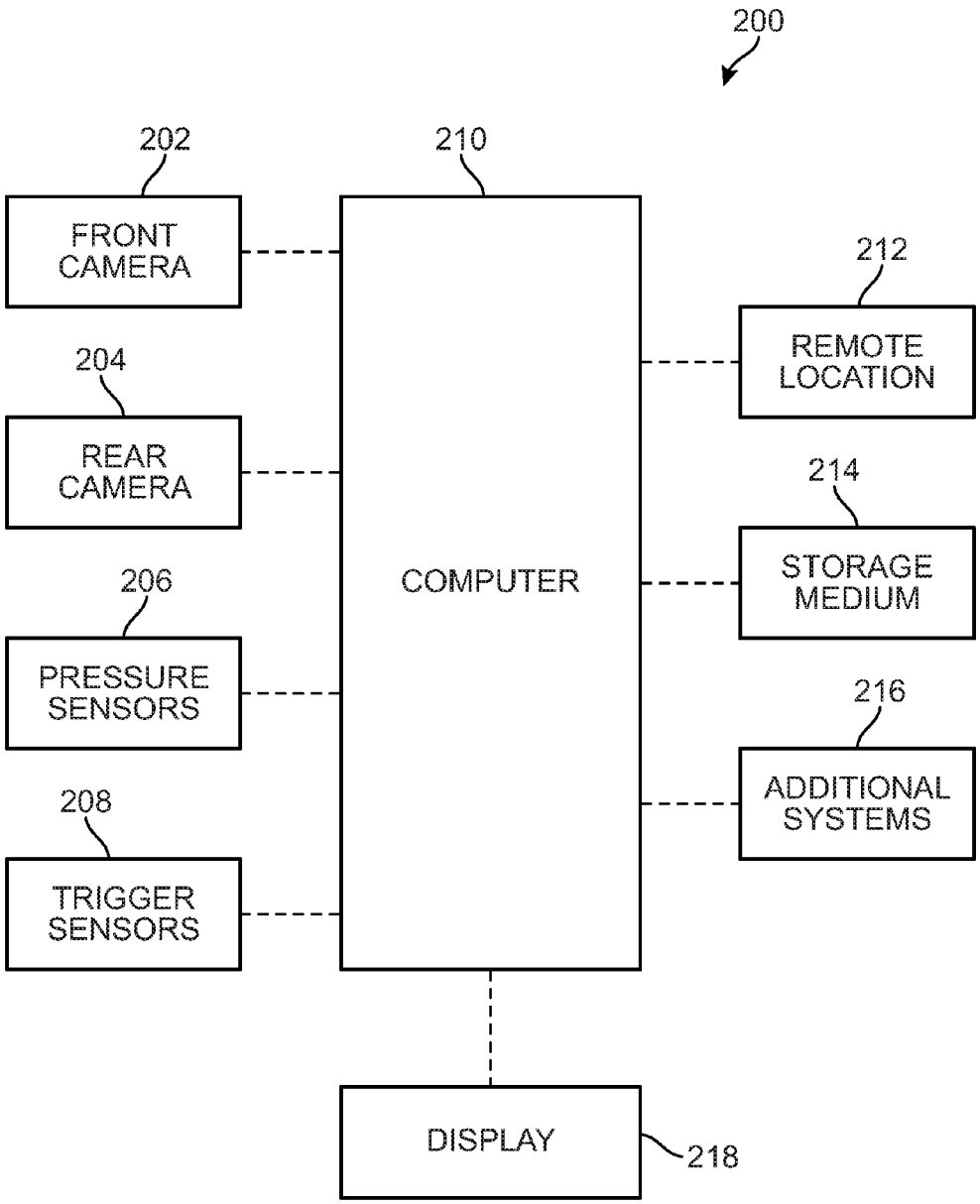
FIG. 2 is a schematic view of an exemplary embodiment of a system for analyzing a low resolution image capture of a golfer's swing.

Referring now to FIG. 2, a schematic view of an exemplary embodiment of a system 200 for analyzing a low resolution image capture of a golfer's swing is illustrated. In some embodiments, system 200 may be configured to capture information associated with a golfer during a golf swing. In some embodiments, system 200 may include one or more components that are configured to capture and/or record information associated with a golf swing of a golfer. Different embodiments of system 200 may include different components. Any of the following components associated with system 200 may be considered optional in some embodiments. Some embodiments may include a given component, while others may exclude it. The following description discloses many of the possible components that may be used with system 200, however, it should be kept in mind that not every component must be used in a given embodiment.

In an exemplary embodiment, system 200 may include one or more sensors for capturing information associated with a swing of a golfer. Captured information associated with a swing of a golfer may include, but is not limited to: visual information, audio information, weight and/or foot pressure information, as well as any other type of sensor that may be used to measure parameters associated with the golfer and/or the golfer's swing. In addition, captured information may be associated with recorded time stamps or other mechanisms for assigning time durations or increments to the captured information.

In one embodiment, system 200 may include one or more components associated with a portable movement capture device configured to capture information associated with a golf swing of a golfer. One such portable movement capture device that may be used in accordance with system 200 and the method described herein is disclosed in commonly owned U.S. Pat. No. 8,982,216, entitled "Portable Movement Capture Device and Method of Finite Element Analysis", and filed on Nov. 4, 2011, which application is incorporated herein by reference in its entirety.

In some embodiments, system 200 may include one or more cameras that are configured to capture images and/or video associated with a golfer's swing. In one embodiment, system 200 may include a front camera 202 that may be used to capture information associated with a golfer's swing from a viewing angle facing the front side of a golfer. In other embodiments, system 200 may further include a rear camera 204 that may be used to capture information associated with a golfer's swing from a viewing angle located behind the golfer.

In this embodiment, front camera 202 and/or rear camera 204 may be a high-speed camera capable of recording audio and/or visual information. In some cases, the high-speed camera may record video. In other cases, the high-speed camera may record multiple still images taken at a rapid rate. In one embodiment, the high-speed camera may capture information at a rate from 600 to 1200 frames per second. In other embodiments, the high-speed camera may capture information at a higher or lower frame rate. In some cases, the high-speed camera may capture information at a rate from 200 to 600 frames per second. In other cases, the high-speed camera may capture information at a rate from 1200 to 2000 frames per second or greater.

In still other cases, front camera 202 and/or rear camera 204 may be configured to capture three-dimensional images and/or video. For example, in some embodiments a 3D camera including multiple lenses may be configured to capture three-dimensional images and/or video. In another embodiment, multiple cameras may be disposed at different locations to capture different views of an object used to create composite three-dimensional images and/or video.

In an exemplary embodiment, the information obtained from front camera 202 and/or rear camera 204 may be low resolution images. The term "low resolution image" as used throughout the specification and the claims refers to an image having a spatial resolution that does not allow sufficiently accurate measurements to be made of objects smaller than approximately 2 inches. For example, low resolution images of a golfer hitting a golf ball would have a spatial resolution that would not allow accurate measurements regarding the exact position of the golf ball to be made from one frame to the next. In other words, images of a low resolution would show a granular appearance when resolving the dimensions of a golf ball. In contrast, a high resolution image would resolve the dimensions of a golf ball smoothly such that it does not appear granular.

It should be understood that while the present embodiments describe a method and system for using a low resolution image capture of a golfer's swing for analysis, the principles described herein would apply equally to a method and system using high resolution images.

In some embodiments, system 200 may include additional components configured to obtain information associated with a golfer during a golf swing. In an exemplary embodiment, system 200 may include pressure sensors 206. In one embodiment, pressure sensors 206 may be disposed under one or both feet of a golfer during the golf swing. In another embodiment, pressure sensors 206 may be disposed within one or more shoes of the golfer. With this arrangement, pressure sensors 206 may be configured to measure the weight transfer between each foot of the golfer at various points in the golfer's swing.

In some embodiments, system 200 may include a component that is configured to detect the beginning of a golfer's swing in order to send a signal to one or more of the components to begin capturing data, including front camera 202, rear camera 204, and/or pressure sensors 206. In an exemplary embodiment, system 200 may include one or more trigger sensors 208 that are configured to detect the beginning of a golfer's swing. In one embodiment, trigger sensors 208 may include an optical sensor, including, but not limited to a CCD device, that may be used to generate a trigger signal. The optical sensor may be configured to detect motions of a golfer associated with the beginning of a golf swing and generate a trigger signal to allow system 200 to begin capturing information. For example, in some cases, the optical sensor may be configured to detect a pause in movement of a golfer's hands and/or club shaft associated with the golfer assuming a ready position to begin the golf swing. In other embodiments, trigger sensors 208 may include a button pressed by the golfer or another user to indicate to system 200 to begin capturing information.

System 200 may also include a computer 210. In various embodiments, computer 210 may include, but is not limited to: a desktop computer, portable computer, tablet computer, smartphone, a processor disposed in a digital camera, and/or any other device including a processor. In some embodiments, computer 210 may be any processing device that is configured to control one or more components of system 200. In addition, computer 210 may optionally include a display 218 that is configured to allow a user to view and/or interact with information. With this arrangement, a user may use computer 210 to view and/or interact with the information obtained with system 200, including allowing a user to analyze captured information associated with the golf swing of a golfer.

In some embodiments, computer 210 may be associated with system 200 so as to transfer the captured information from one or more components of system 200 to computer 210. In an exemplary embodiment, captured information from one or more of front camera 202, rear camera 204, and/or pressure sensors 206 may be transmitted to computer 210. In this embodiment, a connection may be provided to allow information transfer to and/or from computer 210 and various components of system 200, including front camera 202, rear camera 204, and/or pressure sensors 206. The connection may be any type of connection used to transfer information between devices, including, but not limited to USB, Firewire, Ethernet, WiFi, Bluetooth, TCP/IP, as well as any other known wireless or wired connection type. In some cases, the connection may be part of a local area network (LAN). In other cases, computer 210 and additional components may be distant from each other and the connection may be part of a wide area network (WAN). In other embodiments, one or more components of system 200 may be integrated with computer 210. In still other embodiments, front camera 202 and/or rear camera 204 may include a processor that may perform some or all of the functions associated with computer 210, described above.

In addition, in some embodiments, trigger sensors 208 may transmit a trigger signal to computer 210 for controlling any of front camera 202, rear camera 204, and/or pressure sensors 206 to begin capturing information. In other embodiments, trigger sensors 208 may be connected, wirelessly or via a wire, to one or more of front camera 202, rear camera 204, and/or pressure sensors 206 directly.

In some embodiments, system 200 may include one or more additional components located locally or remote from computer 210 and/or system 200. With this arrangement, computer 210 may be configured to transmit the captured information associated with a golfer's swing, including captured image data and/or generated swing analysis outputs, as further described below, to different locations. In one embodiment, a remote location 212 may be in communication with system 200. Remote location 212 may include a remote server or other computer that may assist computer 210 with storing data, processing the captured image data, and/or computing swing analysis outputs, as well as providing additional information that may be relevant to a golfer.

In other embodiments, computer 210 may be configured to transmit information to a storage medium 214. Storage medium 214 may be any known type of storage medium, including known magnetic or optical storage media, and may further include removable and/or portable media. For example, in some embodiments, storage medium 214 may include a portable memory card or other storage medium that may have the golfer's captured information, including captured image data and/or generated swing analysis outputs, stored upon it. The portable memory card or other storage medium may be given to the golfer for later retrieval or use. In other embodiments, storage medium 214 may include one or more databases located on a server.

In still other embodiments, system 200 and/or computer 210 may provide the golfer's captured information, including captured image data and/or generated swing analysis outputs to additional systems 216. Additional systems 216 may include any systems that are configured to use the captured information associated with the golfer's swing as input information. In an exemplary embodiment, additional systems 216 may include any of ball fitting systems, club fitting systems, golfer profile information, and/or training and/or practice regimens.

Figure 3:
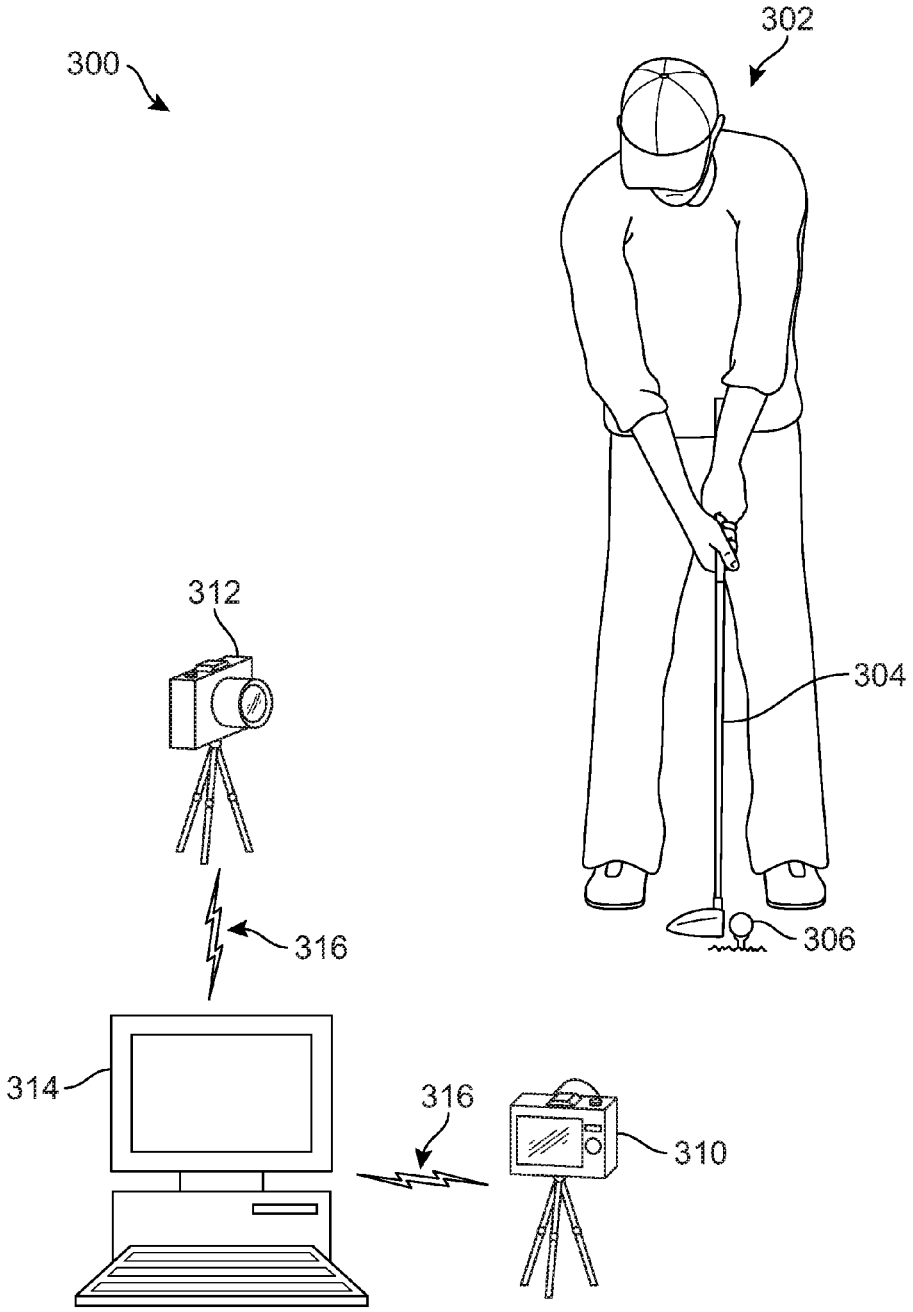
FIG. 3 is an isometric view of an exemplary embodiment of a system obtaining low resolution image capture of a golfer's swing.

FIG. 3 is an isometric view of an exemplary embodiment of a system 300 for obtaining low resolution image capture of a golfer's swing for analysis. In some embodiments, system 300 may be disposed near a golfer 302 to obtain captured images of golfer 302, golf club 304, and/or golf ball 306 during a golf swing by golfer 302. In an exemplary embodiment, system 300 includes a front camera 310. Front camera 310 may be any type of camera, including a camera substantially similar to front camera 202, discussed above. In some embodiments, front camera 310 may be configured to obtain images of golfer 302, golf club 304, and/or golf ball 306 from a viewing angle facing towards the front of golfer 302. In one embodiment, system 300 may further include a rear camera 312. Rear camera 312 may be any type of camera, including a camera substantially similar to rear camera 204, discussed above. In some embodiments, rear camera 312 may be configured to obtain images of golfer 302, golf club 304, and/or golf ball 306 from a viewing angle behind golfer 302.

In an exemplary embodiment, front camera 310 and/or rear camera 312 may be high-speed cameras that are configured to obtain low resolution images of golfer 302, golf club 304, and/or golf ball 306 during various points of the golf swing. The captured images may be further processed to obtain information associated with the golfer's swing, as further described below. In some embodiments, front camera 310 and/or rear camera 312 may be a professional camera. In other embodiments, front camera 310 and/or rear camera 312 may be a consumer camera available to purchase at a retail store.

In this embodiment, system 300 includes a computer 314. Computer 314 may be any kind of computer, including a computer substantially similar to computer 210, discussed above. In some embodiments, computer 314 may be configured to control one or more of front camera 310 and/or rear camera 312 to obtain images. In an exemplary embodiment, computer 314 may communicate wirelessly with front camera 310 and/or rear camera 312 over wireless connection 316. In other embodiments, however, computer 314 may communicate with various components of system 300 via any known wireless or wired connection, as described above.

In addition, in this embodiment, system 300 may include additional components that are not shown to assist system 300 with capturing information associated with the golf swing of golfer 302. In an exemplary embodiment, one or more pressure sensors (not shown), including pressure sensors substantially similar to pressure sensors 208, discussed above, may be included and associated with the feet of golfer 302. System 300 may further include any of the additional components described above in regard to system 200.

Referring now to FIGS. 4 through 9, different exemplary views of captured information associated with a swing of golfer 302 are shown. In some embodiments, captured information associated with a swing of golfer 302 may be used to calculate one or more parameters associated with positions of a golfer's body and/or golf club position during the swing.

Figure 4:
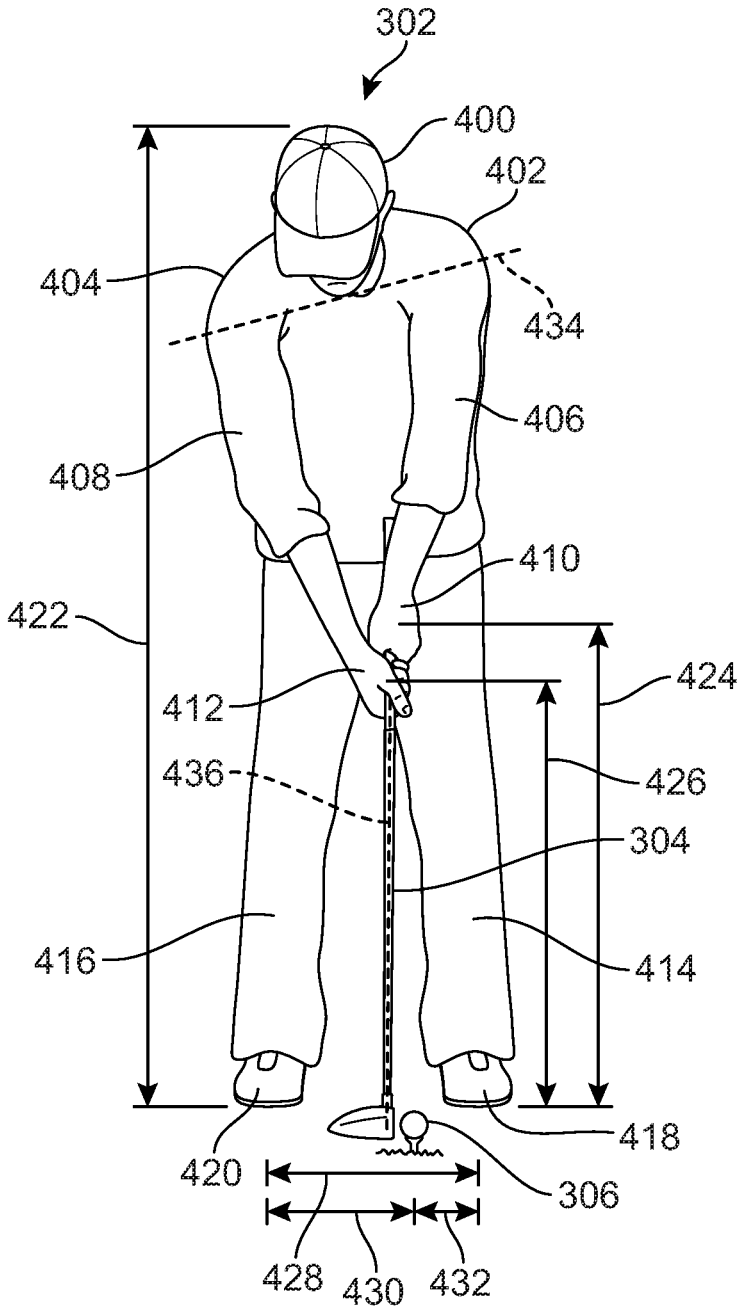
FIG. 4 is a representational view of an exemplary embodiment of a static image capture of a golfer taken from a front view.

Referring now to FIG. 4, a representational view of an exemplary embodiment of an image capture of golfer 302 during a static initial address taken from a front view is illustrated. In one embodiment, front camera 310, discussed above, may be used to obtain captured information associated with golfer 302 at the beginning of a swing during a static initial address. In an exemplary embodiment, the captured information associated with the beginning of the swing may be generally static information related to absolute or relative positions of portions of golfer 302, golf club 304, and/or golf ball 306 during the initial address or setup of golfer 302 in preparation of taking a swing.

In some embodiments, one or more portions of golfer 302 may be identified in the static captured image taken at the beginning of the swing for later comparison during different portions of the swing of golfer 302. Generally, the portions of interest of golfer 302 may be associated with various regions of golfer 302. For purposes of reference, portions of golfer 302 may be described using terms that are relative to the direction of travel of a golf ball to describe both right-handed or left-handed golfers. Accordingly, as used throughout the specification and claims, portions of golfer 302 described as being "front" refer to a direction facing towards the direction of travel of the golf ball and portions of golfer described as being "back" refers to the opposite direction away from the direction of travel of the golf ball.

In an exemplary embodiment, a head/body region of golfer 302 may be associated with a head 400, a front shoulder 402, a back shoulder 404, and/or the hips of golfer 302. Additionally, an arm/club region of golfer 302 may be associated with a front arm 406, a back arm 408, a front hand 410, a back hand 412, and/or golf club 304. Finally, a lower body/foot region of golfer 302 may be associated with a front leg 414, a back leg 416, a front foot 418, and/or a back foot 420. It should be understood that the various regions described herein are merely exemplary and any portion of golfer 302 that is of interest may be associated with any region. In some embodiments, the positions of any one or more portions of golfer 302 associated with each region may be captured using a high-speed camera for analysis of the movement of golfer 302 during a golf swing.

In some embodiments, the captured information may include one or more images that may be used to calculate absolute or relative positions of portions of golfer 302, golf club 304, and/or golf ball 306 during the initial address or setup of golfer 302 in preparation of taking a swing. The calculated positions may include locations measured in terms of Cartesian coordinates, such as points along an x-axis and/or y-axis, as well as relative positions measured in terms of distances between two or more objects. In some cases, the calculated positions and measurements may be measured relative to a static golf ball position. With this arrangement, the static golf ball position may be used as an origin point for calculating or measuring relative distances and/or angles. In other cases, an external point of reference, for example, a designated mark on a wall or other object, may be used as an origin point for calculating or measuring relative distances and/or angles.

In this embodiment, a first height 422 associated with the height of golfer 302 from the ground surface to head 400 is calculated from the captured information. Similarly, a second height 424 associated with the position of front hand 410 and a third height 426 associated with the position of back hand 412 may also be calculated from the captured information.

In some embodiments, captured information may be used to calculate parameters associated with absolute foot position and separation, as well as relative foot position with respect to the location of golf ball 306. In this embodiment, a first distance 428 associated with the separation of front foot 418 and back foot 420 is calculated. Similarly, a first relative distance 430 between the position of back foot 420 and golf ball 306 may be calculated, as well as a second relative distance 432 between the position of front foot 418 and golf ball 306 may be calculated from the captured information.

In addition, in some embodiments, relative positions in terms of angular displacement may be calculated from the captured information. In an exemplary embodiment, the relative position of front shoulder 402 and back shoulder 404 of golfer 302 may be calculated as a shoulder angle 434. Similarly, the relative position of ends of golf club 304 between a proximal end associated with front hand 410 and back hand 412 and a distal end adjacent to the ground surface may be calculated as a club shaft angle 436. In other embodiments, additional measurements may be obtained from the captured static image of golfer 302 obtained before golfer 302 has started his or her swing.

Figure 5:
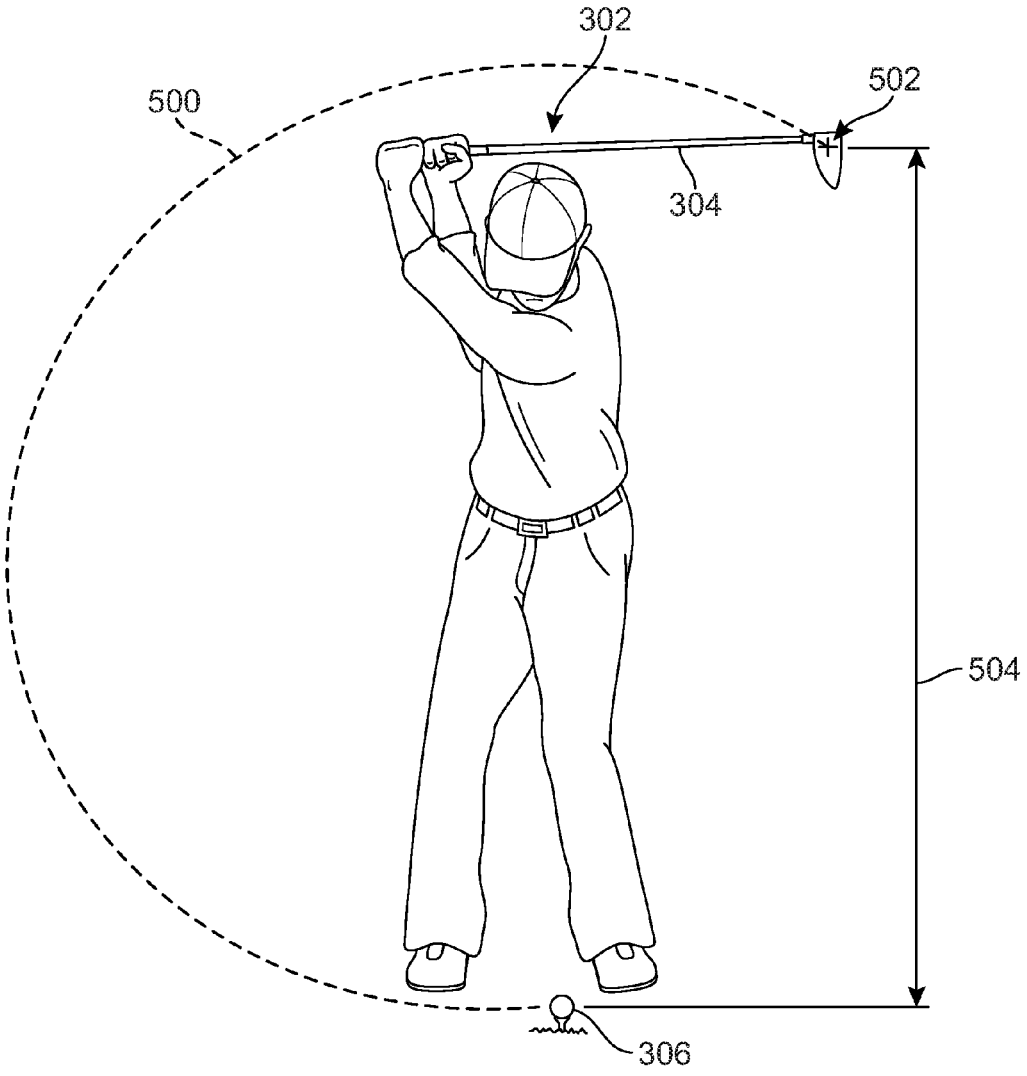
FIG. 5 is a representational view of an exemplary embodiment of a backswing image capture of a golfer's swing taken from a front view.

Referring now to FIG. 5, a representational view of an exemplary embodiment of a backswing image capture of golfer 302 taken from a front view is illustrated. In one embodiment, front camera 310, discussed above, may be used to obtain captured information associated with golfer 302 during the backswing. In some embodiments, the captured information may include a trace 500 depicting the path of a club head of golf club 304 as it travels along various points during the backswing. In an exemplary embodiment, captured information may include one or more images taken at different times during the backswing. In some cases, the number of images taken during the backswing may be determined based on the frame rate capabilities of front camera 310. In other cases, a predetermined number of images may be taken during the backswing.

In an exemplary embodiment, the captured information associated with the backswing may be information related to absolute or relative positions of portions of golfer 302, golf club 304, and/or golf ball 306 during the backswing. In one embodiment, an end position 502 of the club head of golf club 304 may be calculated. End position 502 may represent the final position of the club head during the backswing, just prior to a transition to the downswing or forward swing of golfer 302. In addition, a fourth height 504 associated with the height of the club head of golf club 304 during the backswing may be calculated from a measurement of the distance between end position 502 and the ground surface. In other embodiments, additional parameters associated with one or more portions of golfer 302 may be calculated from measurements of captured information along various points during the backswing illustrated in FIG. 5.

Figure 6:
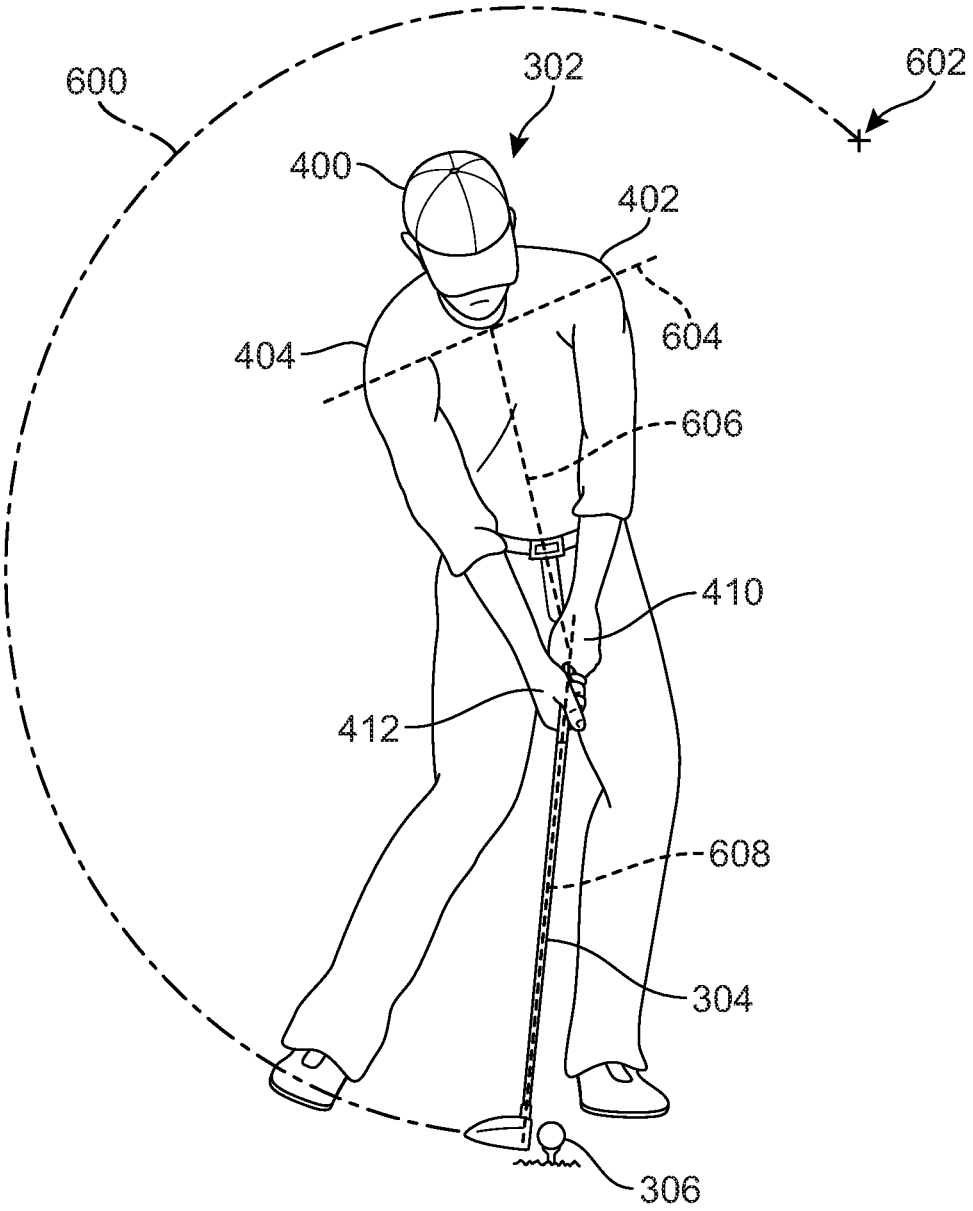
FIG. 6 is a representational view of an exemplary embodiment of a forward swing image capture of a golfer's swing taken from a front view.

Referring now to FIG. 6, a representational view of an exemplary embodiment of a forward swing image capture of golfer 302 taken from a front view is illustrated. In one embodiment, front camera 310, discussed above, may be used to obtain captured information associated with golfer 302 during the downswing and/or forward swing towards hitting golf ball 306. In some embodiments, the captured information may include a trace 600 depicting the path of a club head of golf club 304 as it travels along various points during the downswing and forward swing. In an exemplary embodiment, captured information may include one or more images taken at different times during the downswing and/or forward swing. In some cases, the number of images taken during the downswing and/or forward swing may be determined based on the frame rate capabilities of front camera 310. In other cases, a predetermined number of images may be taken during the downswing and/or forward swing.

In an exemplary embodiment, the captured information associated with the downswing and/or forward swing may be information related to absolute or relative positions of portions of golfer 302, golf club 304, and/or golf ball 306 during the downswing and/or forward swing. In one embodiment, a start position 602 of the club head of golf club 304 may be calculated. Start position 602 may represent the beginning position of the club head during the downswing, just after the transition from the backswing of golfer 302. In an exemplary embodiment, start position 602 may be substantially similar to end position 502 of the downswing, discussed above.

In some embodiments, additional parameters associated with one or more portions of golfer 302 may be calculated from measurements of captured information along various points during the downswing and/or forward swing illustrated in FIG. 6. In one embodiment, a shoulder angle 604 associated with the relative positions of front shoulder 402 and rear shoulder 404 may be calculated from captured images of golfer 302 during the downswing and/or forward swing. In some embodiments, a hand angle 606 associated with positions of front hand 410 and rear hand 412 relative to position of head 400 may be determined. In still other embodiments, an impact club shaft angle 608 associated with the relative position of ends of golf club 304 between a proximal end associated with front hand 410 and back hand 412 and a distal end adjacent to the ground surface may be calculated during the forward swing prior to impact with golf ball 306.

In other embodiments, additional relative or absolute positions of portions of golfer 302, golf club 304, and/or golf ball 306 may be calculated at various points along the downswing and/or forward swing of golfer 302.

Figure 7:
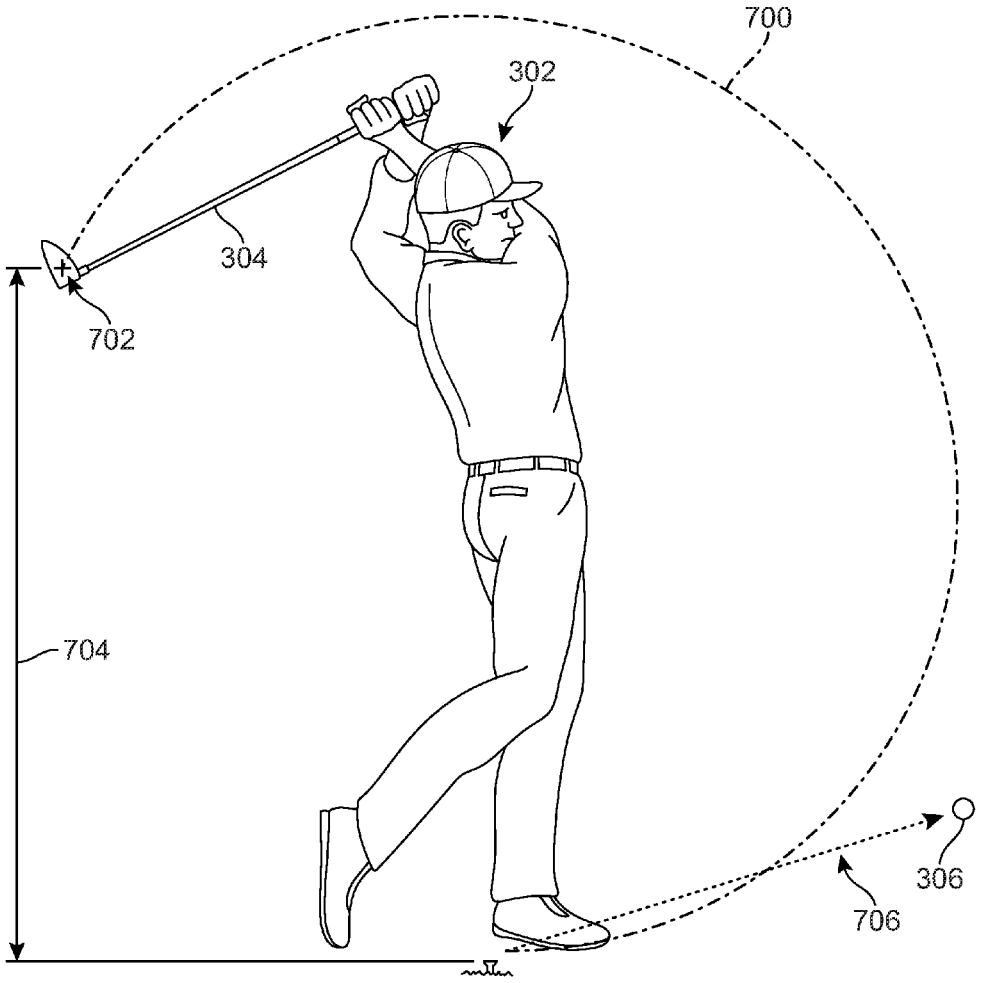
FIG. 7 is a representational view of an exemplary embodiment of a follow-through image capture of a golfer's swing taken from a front view.

Referring now to FIG. 7, a representational view of an exemplary embodiment of a follow-through image capture of golfer 302 taken from a front view is illustrated. In one embodiment, front camera 310, discussed above, may be used to obtain captured information associated with golfer 302 during the follow-through of the swing after hitting golf ball 306. In some embodiments, the captured information may include a trace 700 depicting the path of a club head of golf club 304 as it travels along various points during the follow-through of the swing. In an exemplary embodiment, captured information may include one or more images taken at different times during the follow-through. In some cases, the number of images taken during the follow-through may vary, as discussed above with reference to the backswing, downswing, and/or forward swing.

In one embodiment, a finish position 702 of the club head of golf club 304 may be calculated. Finish position 702 may represent the final position of the club head at the end of the follow-through of the swing of golfer 302. In addition, a fifth height 704 associated with the height of the club head of golf club 304 at the end of the follow-through may be calculated from a measurement of the distance between finish position 702 and the ground surface.

In some embodiments, one or more measurements associated with golf club 304 hitting golf ball 306 may be calculated using captured image information. In some cases, while the captured images may be of such a low resolution as to make accurate calculations of fine measurements associated with hit golf ball 306 difficult, coarse measurements associated with golf ball 306 may be possible. In an exemplary embodiment, images from follow-through may be of sufficient resolution to permit calculation of a launch angle 706 associated with hit golf ball 306. In another embodiment, a club head speed of golf club 304 and/or an initial velocity of golf ball 306 after impact may also be calculated using captured images from follow-through of golfer 302. In another embodiment, the angle of attack associated with the swing of golfer 302 may be determined. The angle of attack represents the angle of the path of club head of golf club 304 as it travels toward, and then makes contact with, golf ball 306. In other embodiments, additional parameters associated with one or more portions of golfer 302 may be calculated from measurements of captured information along various points during the follow-through illustrated in FIG. 7.

Figure 8:
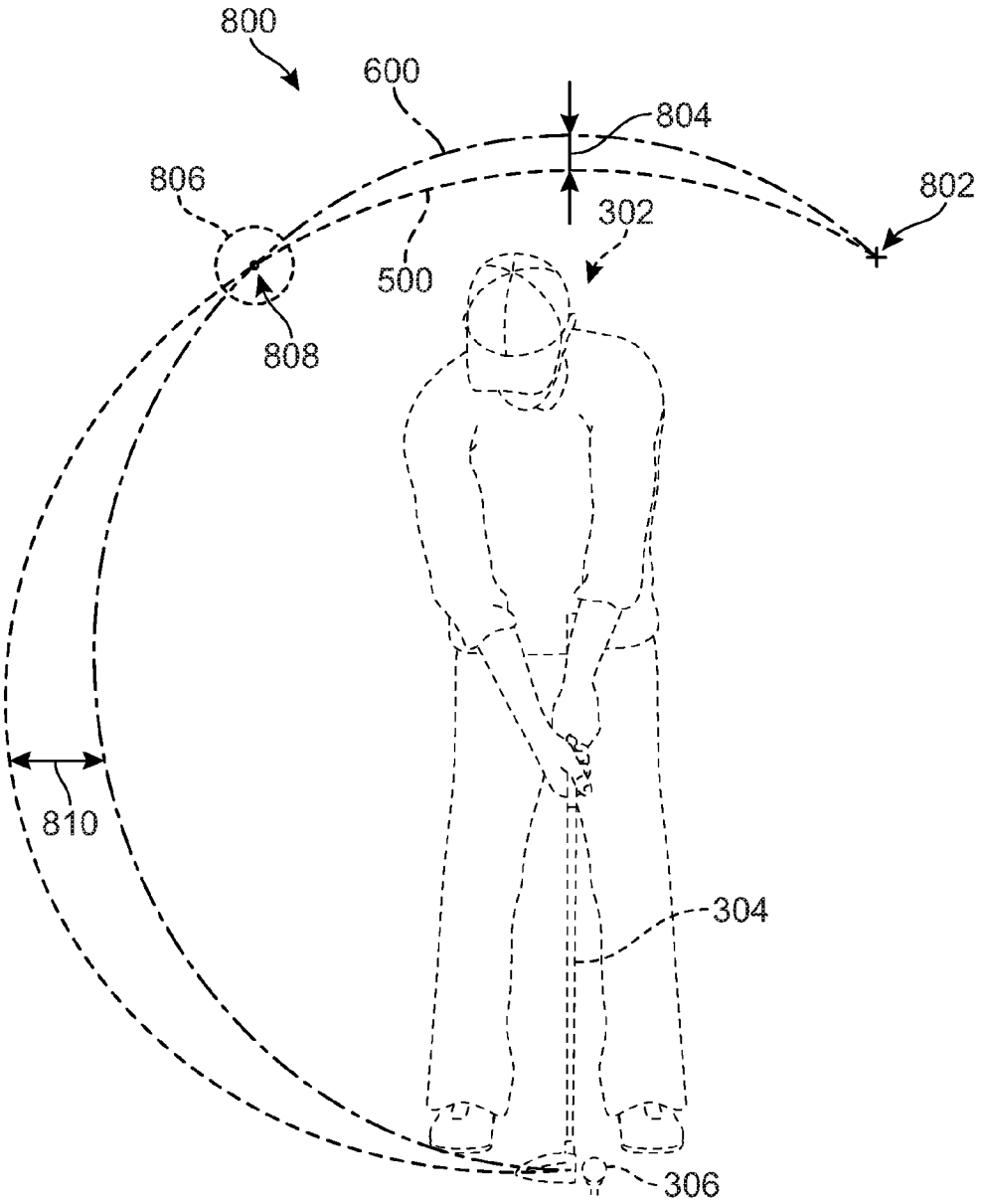
FIG. 8 is a representational view of an exemplary embodiment of a composite image capture of a golfer's backswing and forward swing.

In some embodiments, composite information comparing the calculated positions of portions of golfer 302, golf club 304, and/or golf ball 306 during various portions of the swing illustrated in FIGS. 4 through 7 may be used to measure swing characteristics associated with golfer 302. Referring now to FIG. 8, a composite view 800 is illustrated comparing positions of portions of golfer 302, golf club 304, and/or golf ball 306 along a backswing, as illustrated in FIG. 5 above, and a downswing and/or forward swing, as illustrated in FIG. 6 above.

In this embodiment, trace 500 depicts the path of a club head of golf club 304 as it travels along various points during the backswing and trace 600 depicts the path of the club head of golf club 304 as it travels along various points during the downswing and forward swing. A transition point 802 represents the transition between the backswing to the downswing. In some cases, transition point 802 is substantially similar to end position 502 and/or start position 602, discussed above.

In some embodiments, composite view 800 may include comparative information that may be measured between trace 500 and trace 600. In an exemplary embodiment, a vertical apex displacement distance 804 may be calculated from measurements associated with the highest point associated with the club head of golf club 304 during each of the backswing and the downswing. In one embodiment, an inflection zone 806 may be associated with an area of composite view 800 that represents a predetermined area where trace 500 associated with the backswing crosses over trace 600 associated with the downswing or forward swing of golfer 302 at a crossing point 808. In an exemplary embodiment, a horizontal apex displacement distance 810 may be calculated from measurements associated with the farthest point of the club head of golf club 304 from golfer 302 during each of the backswing and the downswing.

In addition, other parameters may be compared relative to similar measurements taken at various points along the swing of golfer 302. In some cases, measurements of foot pressure sensors associated with weight transfer during one or more of the backswing, downswing and/or forward swing, and follow-through, may be compared to determine measurements associated with body pivoting. Similarly, time measurements associated with each portion of the swing of the swing of golfer 302 may be obtained from time stamp information or other time-related information included with the captured information. In some embodiments, time measurements may be then compared during one or more of the backswing, downswing and/or forward swing, and follow-through to determine measurements associated with the timing of the swing.

Figure 9:
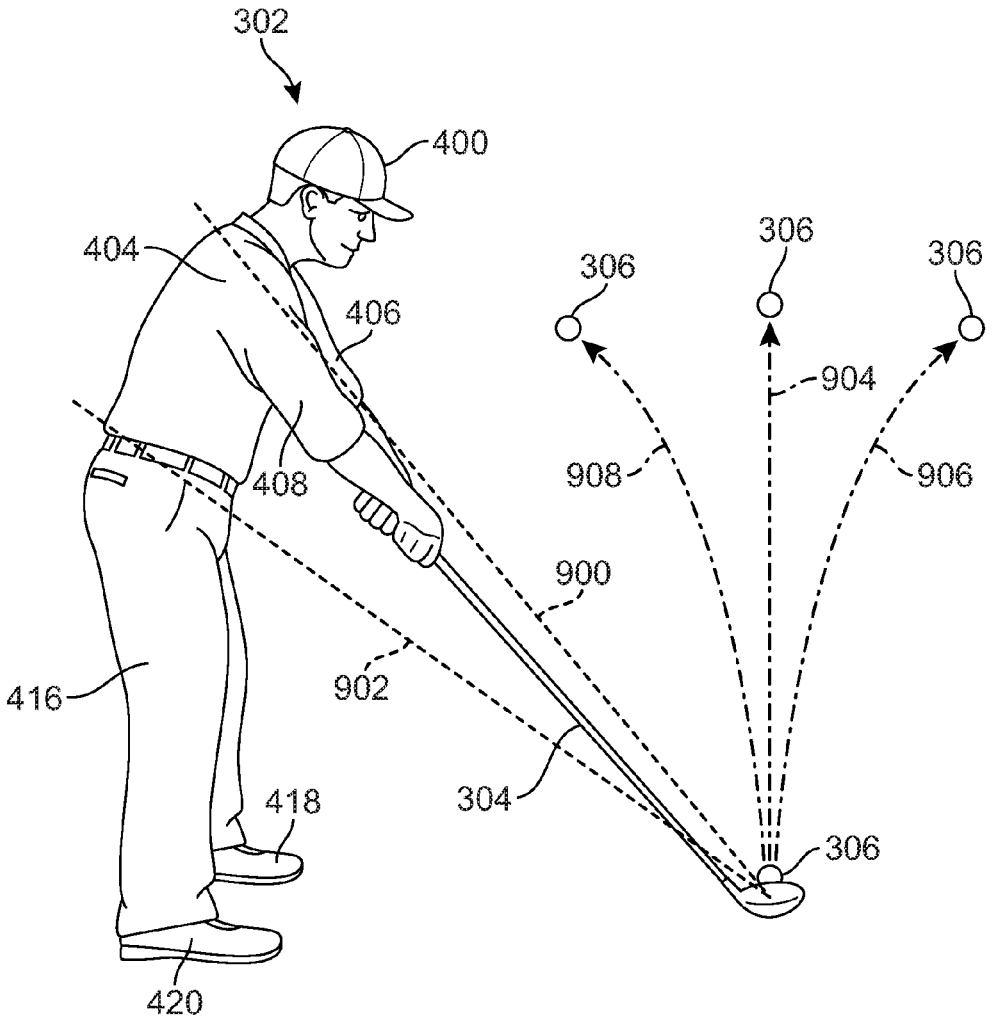
FIG. 9 is a representational view of an exemplary embodiment of an image capture of a golfer's swing taken from a rear view.

In some embodiments, captured information may be obtained from a camera located behind golfer 302. In some cases, calculations may be obtained from a camera with a viewing angle located behind golfer 302 that would not be possible using a camera with a viewing angle facing golfer 302. Referring now to FIG. 9, a representational view of an exemplary embodiment of an image capture of a swing of golfer 302 taken from a rear view is illustrated. In one embodiment, rear camera 312, discussed above, may be used to obtain captured information associated with golfer 302 during any portion of the swing. In this embodiment, a forward swing is illustrated, however, rear camera 312 may be configured to capture information associated with any portion of the swing, including any one or more of the backswing, downswing and/or forward swing, and follow-through as discussed above. In some cases, the number of images taken using rear camera 312 may vary, as discussed above with reference to the backswing, downswing, and/or forward swing and camera 310.

In some embodiments, the captured information may include determining a torso position of golfer 302 upon impact of golf club 304 with golf ball 306. In this embodiment, a shoulder line 900 represents a measured angle between rear shoulder 404 of golfer 302 and the club head of golf club 304. Similarly, a waist line 902 represents a measured angle between the waist or hips of golfer 302 and the club head of golf club 304.

In an exemplary embodiment, the captured information may further include initial flight path information associated with hit golf ball 306. In this embodiment, rear camera 312 may obtain images associated with the immediate trajectory of golf ball 306 after being hit. In some cases, golf ball 306 may follow a generally straight flight path 904. However, in other cases, golf ball 306 may immediately take a path to either direction, including a slice flight path 906 associated with golf ball 306 traveling to the right and a hook flight path 908 associated with golf ball 306 traveling to the left. In this embodiment, the initial flight path information may not be available to front camera 310. As a result, rear camera 312 may provide additional information associated with a swing of golfer 302 that would not otherwise be available.

Figure 10:
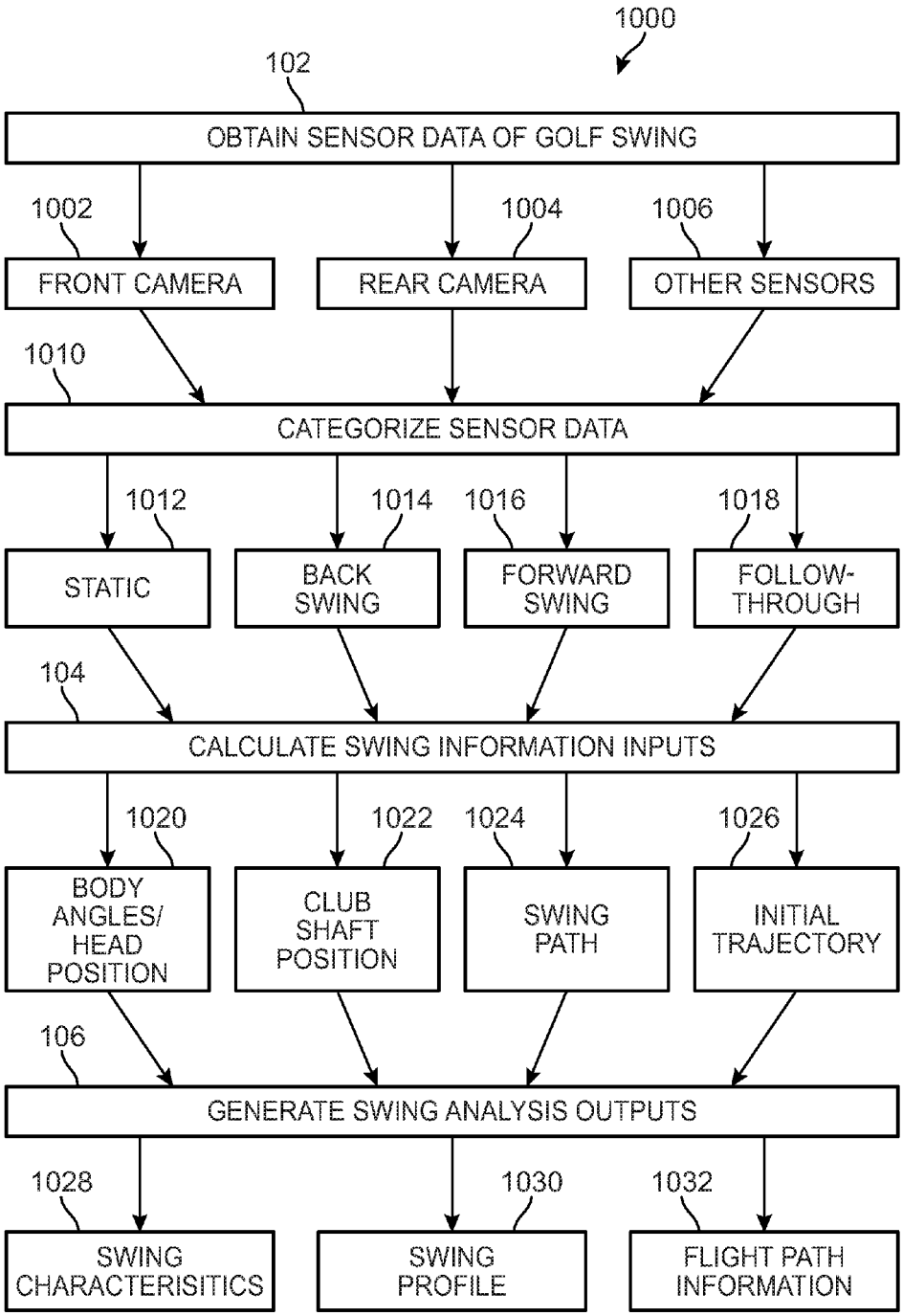
FIG. 10 is a representational view of an exemplary embodiment of a process for using low resolution image capture inputs associated with a golfer's swing to generate swing analysis outputs.

In some embodiments, captured information and/or calculated and measured parameters associated with the various portions of the swing of a golfer may be used to generate swing analysis outputs. Referring now to FIG. 10, a representational view of an exemplary embodiment of a process 1000 for using low resolution image capture inputs associated with a golfer's swing to generate swing analysis outputs is illustrated. In some embodiments, one or more steps of process 1000 may be performed using a computer or processor, including one or more of computer 210, computer 314, and/or a remote computer, described above.

In some embodiments, process 1000 may include one or more steps associated with process 100, described above. In an exemplary embodiment, process 1000 may include additional detailed steps configured to categorize and group portions of the obtained inputs from step 102 to assist with generating swing analysis outputs at step 106.

In one embodiment, sensor data associated with a golf swing of a golfer may be obtained from one or more sources at step 102. In an exemplary embodiment, the sensor data obtained at step 102 may be obtained from one or more cameras, including high-speed cameras, as described above, including obtaining captured information from a front camera at step 1002. In some embodiments, process 1000 may further include obtaining captured information from a rear camera at step 1004. In other embodiments, process 1000 may optionally include obtaining additional data from other sensors at step 1006, including pressure sensor information, as described above.

In some embodiments, process 1000 may include a step 1010 of categorizing the sensor data obtained from step 102, step 1002, step 1004, and/or step 1006. In an exemplary embodiment, the product of step 1010 may be categorization of sensor data according to various portions of the swing of the golfer. In some cases, process 1000 may use time stamped information or other time-related indications to assist with categorizing the sensor data at step 1010. In an exemplary embodiment, categorization of the sensor data at step 1010 may include categorizing the sensor data as being associated with a static portion 1012, a backswing portion 1014, a forward swing portion 1016, and/or a follow-through portion 1018.

Using the categorized sensor data from step 1010, process 1000 may further include the step of calculating swing information inputs at step 104. In this embodiment, the calculated swing information inputs at step 104 may include any of the measured and/or calculated parameters and quantities described in reference to FIGS. 4 through 9 above. In an exemplary embodiment, the calculated swing information inputs may be further described as being related to different types of captured information. In this embodiment, the different types of captured information includes body angles/head positions 1020, club shaft positions 1022, swing path information 1024, and/or initial trajectory 1026 of a golf ball, as described above.

In an exemplary embodiment, body angles/head positions 1020 may include information associated with body angles, head position, shoulder positions, arm positions, hand positions, leg positions, and foot positions, as well as any other portion of golfer 302. Club shaft positions 1022 may include information associated with club shaft angles and club head position of golf club 304, as well as related information, such as hand positions and/or arm positions of golfer 302. Initial trajectory 1026 may include coarse measurements associated with the flight path of golf ball 306, including an initial velocity, launch angle, and initial trajectory direction.

In an exemplary embodiment, process 1000 may be configured to use one or more of the calculated swing information inputs, including, but not limited to body angles/head positions 1020, club shaft positions 1022, swing path information 1024, and/or initial trajectory 1026, to generate swing analysis outputs at step 106. In different embodiments, swing analysis outputs generated by process 1000 at step 106 may include one or more of swing characteristics 1028, swing profile information 1030, and flight path information 1032.

In some embodiments, swing analysis outputs generated at step 106 may be used to provide recommendations and/or feedback to a golfer regarding the details of his or her swing and steps to obtain improved results. FIGS. 11A and 11*b* illustrate a representational view of an exemplary embodiment of a table 1100 correlating swing analysis outputs associated with a golfer's swing to specific recommendations to the golfer for improvements or corrections.

In some embodiments, table 1100 may be embodied as a program or algorithm running on a computer or processor, located either locally or remotely, and configured to use one or more of the swing analysis outputs generated at step 106 of process 1000, described above, to provide relevant recommendations and/or feedback to a golfer regarding his or her swing. In some cases, the captured information obtained at step 102, described above, may be processed automatically using the computer or processor to generate the recommendations and/or feedback in table 1100. In other cases, table 1100 may be a lookup table or database that correlates one or more of the swing analysis outputs to a predetermined recommendation or feedback.

In this embodiment, table 1100 may be organized relative to a swing progression 1102 that identifies the relevant portion of the swing from which the swing analysis output was generated. In this embodiment, table 1100 may be organized into a first portion shown in FIG. 11A associated with a swing of a golfer from an initial address to a backswing and into the transition to the downswing. Table 1100 may further be organized into a second portion shown in FIG. 11B associated with a swing of a golfer from the transition to the downswing into the downswing, through the forward swing and to impact and follow-through. In other embodiments, table 1100 may be organized according to different criteria. In addition, it should be noted that table 1100 is merely exemplary and may include a larger or smaller number of identified swing analysis outputs 1104, as well as a larger or small number of recommendations and/or feedback 1110.

In an exemplary embodiment, table 1100 includes a first column associated with one or more discrete swing analysis outputs 1104. Table 1100 may also include a second column indicating the source 1106 of the captured information that relates to the relevant swing analysis output 1104. In some cases, source 1106 may identify one or more of a front camera, rear camera, foot pressure sensors, or any other sensor sources used to capture information associated with a swing of a golfer.

Next, in some embodiments, table 1100 may further include a third column that correlates a discrete swing analysis output from column 1104 with an effect 1108 that may result on the golf ball. In an exemplary embodiment, table 1100 also includes a fourth column including one or more recommendations and/or feedback 1110 for the golfer to take to counteract the identified effects 1108 for the given swing analysis output 1104. With this arrangement, the system and method described herein may be configured to provide a golfer with analysis of his or her swing and correlate the identified swing analysis outputs to specific recommendations for improving one or more of swing characteristics, swing profile, and/or initial flight path/trajectory of the golf ball.

For example, captured images taken from a front camera may identify that a golfer cocks his or her wrists at initial take away of beginning a swing, resulting in a golf ball that has more spin and a flight path associated with a slice. As a result, table 1100 provides the golfer with a recommendation to use a golf ball associated with a lower amount of spin and/or to practice to eliminate the identified issue with the swing.

In another example, captured images taken from a rear camera may identify that a golfer has an inside/outside movement of the club head of the golf club at initial take away of beginning a swing, resulting in a golf ball that has a flight path associated with a hook or a slice. As a result, table 1100 provides the golfer with a recommendation to use a golf ball associated with a lower amount of spin and/or to practice to eliminate the identified issue with the swing. In some embodiments, a rear camera may also be used to obtain captured images that identify that a golfer has an over the top transition from backswing to downswing, causing more sidespin and/or backspin than may be desired. In this case, table 1100 provides a recommendation to use a golf ball associated with a lower amount of spin and/or to practice to eliminate the identified issue with the swing.

Similarly, captured images taken from a front camera may identify that a golfer has too long of a backswing, or has head and/or body sway during a backswing instead of a rotation of the torso, both of which table 1100 indicates may be corrected with increased practice. Captured images taken from a front camera may also be used to identify and/or calculate an x-factor angle associated with the angle between the rotation of the shoulders and hips at the top of the backswing. A smaller x-factor angle may cause a decrease in power and spin. As a result, table 1100 provides the golfer with a recommendation to use a golf ball configured to increase distance and/or to increase flexibility to increase the golfer's ability to rotate the shoulders relative to the hips.

In some embodiments, a swing analysis output 1104 may be associated with multiple input sources 1106. For example, either or both of a front camera and a rear camera may be used to identify that a golfer lifts his or her heel during a backswing, resulting in a loss of distance when hitting the golf ball. As a result, table 1100 provides the golfer with a recommendation to use a golf ball configured to increase distance and/or to increase flexibility to avoid lifting the heel. Similarly, a loss of distance may also result from casting at the top of the backswing, caused by a failure to maintain a wrist angle during the downswing detected using captured images from a front camera. Accordingly, table 1100 provides the golfer with a recommendation to use a golf ball configured to increase distance and/or to practice maintaining the wrists during the downswing.

In another embodiment, other sensor data may be used, either alone or in combination with the captured images from a front camera and/or a rear camera, to identify a swing analysis output 1104. For example, referring now to FIG. 11B, in one embodiment, source 1106 may include a front camera and/or foot pressure sensors to identify a reverse pivot in a golfer's swing associated with having weight forward on the backswing and weight backwards on the downswing, resulting in inconsistent contact with the golf ball and/or a loss of distance. To correct this issue, table 1100 provides a recommendation to use a golf ball configured to improve play, such as a 2 piece or 3 piece game improvement ball, and/or to practice shifting weight correctly during backswing and downswing.

In some embodiments, swing analysis output 1104 may use comparative calculations between one or more portions of a swing of golfer. For example, a disparity in the ratio between the time associated with a backswing and the time associated with a downswing obtained from a front camera may result in a recommendation in table 1100 that the golfer practice more to equalize the timing of his or her swing. Similarly, a swing analysis output 1104 that indicates that the golfer is dropping or raising his or her head from initial set up of the swing can result in an effect 1108 that the golf ball has less spin and a higher launch or more spin and a lower launch. Accordingly, table 1100 provides a recommendation to use a golf ball associated with a lower trajectory and higher spin or a higher trajectory and lower spin, respectively, and to practice more to prevent movement of the head.

In some embodiments, swing analysis outputs 1104 may include analysis of captured images associated with a golf club and/or golf ball, either alone or relative to one or more portions of a body of the golfer. For example, in one embodiment, a front camera may be used to capture images used to calculate that the golfer has a high angular speed transfer from his or her forearms to the golf club, resulting in more spin on the golf ball when hit. As a result, table 1100 provides a recommendation to use a golf ball associated with a lower amount of spin.

Similarly, a front camera may also be used to capture images used to identify a launch angle of the golf ball, which table 1100 provides recommendations to change using different golf balls associated with various dimple patterns and/or ball compression values to change the launch angle as desired. The front camera may also be used to capture images used to identify the angle of attack. Generally, a steeper angle of attack may cause a golf ball to exhibit a larger amount of spin when hit and a shallower angle of attack may cause a golf ball to exhibit a smaller amount of spin. Accordingly, table 1100 provides a recommendation to use a golf ball associated with lower amount of spin or higher amount of spin, respectively.

In another embodiment, a rear camera may also be used to capture images used to identify parameters associated with an initial trajectory of a golf ball. For example, a rear camera may identity that a golf ball travels on a trajectory immediately to the left or right. As a result, table 1100 provides a recommendation to vary the choice of golf ball based on the contact time of the impact to increase or decrease the compression of the ball as needed to correct the trajectory.

As noted above, the correlations listed in table 1100 are merely exemplary and additional correlations generated using swing analysis outputs according to the principles described herein may be made to assist a golfer with improving one or more portions of his or her swing.

Figure 12:
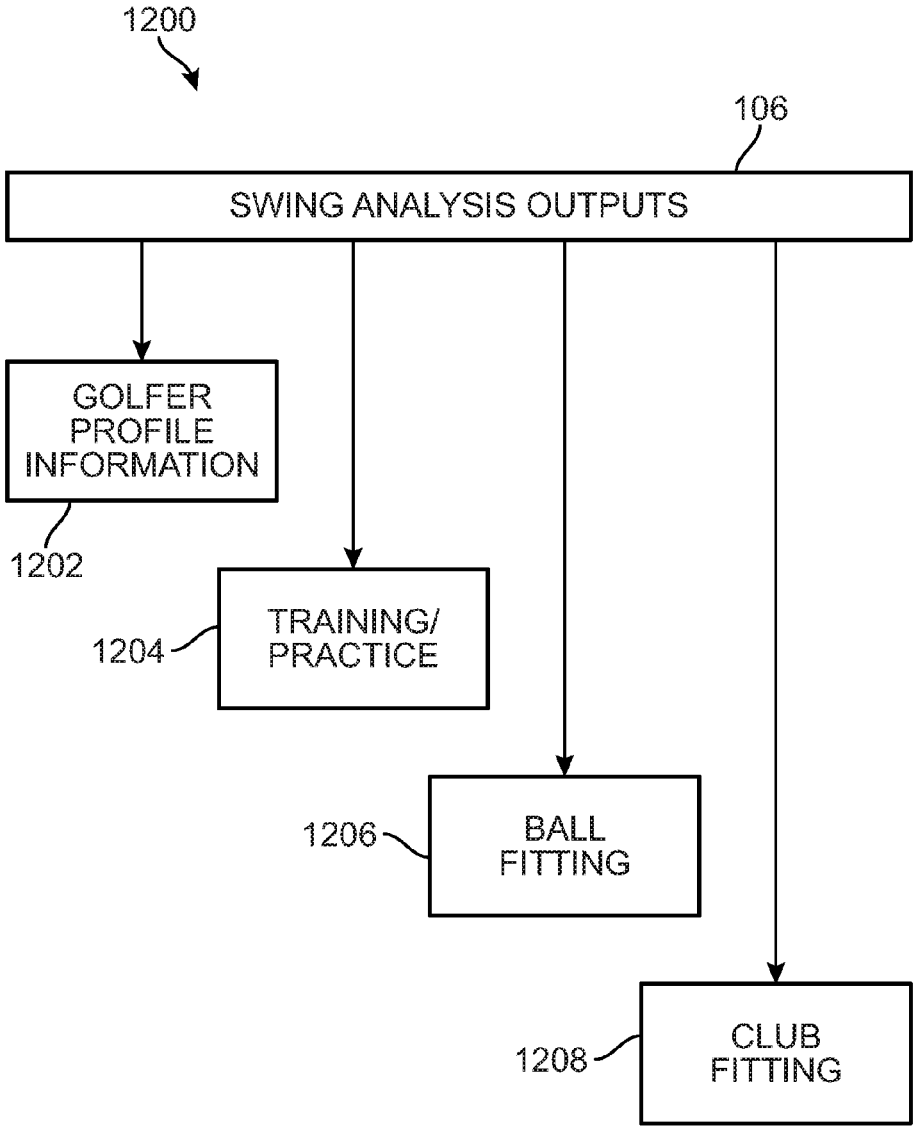
FIG. 12 is a representational view of an exemplary embodiment of a process for using swing analysis outputs in combination with various golf-related systems.

In some embodiments, swing analysis outputs 106 generated according to process 100 and/or process 1000, described above, may be used an inputs for additional systems. Referring now to FIG. 12, a representational view of an exemplary embodiment of a process 1200 for using swing analysis outputs in combination with various golf-related systems is illustrated.

In one embodiment, process 1200 may include associating swing analysis outputs 106 with golfer profile information 1202. In some cases, a golfer may have golfer profile information 1202 stored in a database or on a removable media to allow a computer to retrieve the golfer profile information. It is also contemplated that a removable media device, such as a portable flash memory device, could be used with a computer to store and/or retrieve a golfer's inputs and information associated with swing analysis outputs 106 as golfer profile information 1202. This would enable a golfer to reevaluate after some time has lapsed to determine how their game has changed over time. This would also enable portability of their information in case of travel or relocation.

In an exemplary embodiment, swing analysis outputs 106 may be used as inputs for training and/or practice purposes, as described above in reference to FIGS. 11A and 11B. With this arrangement, a golfer may use swing analysis outputs 106 to receive recommendations and/or feedback to improve elements of his or her swing.

In some embodiments, swing analysis outputs generated at step 106 may be used as inputs to a system that is configured to assist a golfer select a golf club or golf ball suited to his or her swing characteristics or swing profile. In one embodiment, swing analysis outputs 106 may be used as a component in a club fitting system 1208 and/or a ball fitting system 1206, including the ball fitting system disclosed in commonly owned U.S. Pat. No. 8,758,169, entitled "Method and System for Golf Ball Fitting Analysis", and filed on Jul. 7, 2009, the disclosure of which is hereby incorporated by reference in its entirety. Club fitting systems are discussed in US 2009/0326688, filed on Jan. 29, 2009, and entitled "Systems and Methods for Fitting Golfers with Golf Clubs," the disclosure of which is hereby incorporated by reference in its entirety. Club fitting may include fitting any golf club to a golfer, including, but not limited to putter matching, driver matching, and matching or fitting one or more irons to a golfer.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

The invention claimed is:

1. A method for generating a golf swing analysis output of a golfer's swing, comprising:

obtaining a plurality of images from at least one camera;

calculating relative position or motion data between two or more different portions of a golfer, a golf club, or a golf ball from each of a plurality of the obtained images using a computer;

generating a swing analysis output from the calculated position or motion data, the swing analysis output identifying at least one of swing characteristic information and/or swing profile information associated with the golfer's swing; and providing a swing improvement recommendation based upon the generated swing analysis output.

2. The method of claim 1, wherein the step of obtaining a plurality of images comprises obtaining images associated with one or more portions of the golfer's swing at a frame rate of from 200 frames per second to up to 2000 frames per second.

3. The method of claim 2, wherein the one or more portions of the golfer's swing include one or more of a static initial address, a backswing, a downswing, a forward swing, and a follow-through.

4. The method of claim 3, wherein the step of obtaining a plurality of images further comprises obtaining images associated with at least two portions of the golfer's swing.

5. The method of claim 1, wherein the two or more different portions of the golfer, a golf club, or a golf ball include one or more of body angles, head position, shoulder positions, arm positions, hand positions, leg positions, foot positions, club shaft angles, and club head position.

6. A system for generating a golf swing analysis output of a golfer's swing, the system comprising:

at least one camera for obtaining a plurality of images associated with one or more portions of the golfer's swing at a frame rate of from 200 frames per second to up to 2000 frames per second;

a computer in communication with the at least one camera, the computer being configured to:

calculate position or motion data associated with one or more of a golfer and a golf club based on the obtained images; and generate at least one swing analysis output from the calculated position or motion data, the swing analysis output identifying at least one of swing characteristic information and/or swing profile information associated with the golfer's swing; and provide a swing improvement recommendation based upon the generated swing analysis output.

7. The system of claim 6, further comprising a database in communication with the computer, the database including a correlation table listing one or more swing improvement recommendations corresponding to the at least one swing analysis output.

8. The system of claim 6, wherein the system includes at least two cameras.

9. The system of claim 8, wherein the at least two cameras include:

a first camera disposed in front of the golfer and having a viewing angle facing a front of the golfer; and a second camera disposed behind the golfer and having a viewing angle facing the rear of the golfer.

10. The system of claim 6, further comprising at least one pressure sensor in communication with the computer, the pressure sensor being configured to obtain information associated with weight distribution of the golfer during the golfer's swing.

11. The system of claim 6, wherein the at least one camera is configured to obtain low resolution images associated with one or more portions of the golfer's swing.

12. The system of claim 11, wherein the one or more portions of the golfer's swing include one or more of a static initial address, a backswing, a downswing, a forward swing, and a follow-through.

13. The system of claim 6, further comprising at least one trigger sensor, the trigger sensor being configured to generate a trigger signal for indicating when to begin capturing information associated with the golfer's swing.

* * * * *